United States Patent [19]

Kaeser

[11] Patent Number: 4,469,094

[45] Date of Patent: Sep. 4, 1984

[54] SKIN MASSAGING DEVICE WITH SIMULTANEOUS APPLICATION OF A COSMETIC PRODUCT

[76] Inventor: Charles Kaeser, 18, chemin de Rennier, 1009 Pully, Switzerland

[21] Appl. No.: 370,377

[22] Filed: Apr. 21, 1982

[30] Foreign Application Priority Data

May 4, 1981 [CH] Switzerland ..... 2872/81

[51] Int. Cl.[3] ..... A61H 9/00

[52] U.S. Cl. ..... 128/65; 401/28; 401/264

[58] Field of Search ..... 128/60, 62 R, 65–67; 401/28, 264, 202; 222/449, 453, 380, 385

[56] References Cited

U.S. PATENT DOCUMENTS

| | | | |
|---|---|---|---|
| 904,800 | 11/1908 | Nelson | 128/62 R |
| 1,729,903 | 10/1929 | Stephens | 222/385 |
| 2,448,846 | 9/1948 | Trochim | 128/65 |
| 2,513,772 | 7/1950 | Amer | 128/65 X |
| 2,709,432 | 5/1955 | Ackerman | 128/65 X |
| 2,765,964 | 10/1956 | Hanlon | 222/449 X |
| 3,146,484 | 9/1964 | Lussier et al. | 128/65 X |
| 3,256,551 | 6/1966 | Schwartzman | 401/264 |
| 3,369,706 | 2/1968 | Schnyder | 222/449 |
| 3,994,290 | 11/1976 | Springer et al. | 128/65 X |

FOREIGN PATENT DOCUMENTS

| | | | |
|---|---|---|---|
| 272261 | 12/1969 | Austria | 401/264 |
| 710586 | 9/1931 | France | 128/65 |

*Primary Examiner*—Richard J. Apley
*Assistant Examiner*—David J. Brown
*Attorney, Agent, or Firm*—Ostrolenk, Faber, Gerb & Soffen

[57] ABSTRACT

A skin massage device for both massaging skin and applying a cosmetic product through retractable protuberances on the massaging surface. A first plurality of the protuberances are retractable into the massing surface, and include a piston with an outlet opening in its exterior side. A rod affixed to a housing in the massaging surface is engaged by the piston and this seals the opening. Upon massaging pressure applied to an annular bead on the piston, the piston is retracted into the massaging surface, opening the piston opening and permitting exit of cosmetic product. The piston extends into a housing supported at the massaging surface and the housing communicates into the reservoir for being filled. The piston includes a side wall which blocks communication between the housing and the reservoir when the piston is retracted, whereby cosmetic product in the housing is forced out the opening in the retracted position of the piston.

11 Claims, 5 Drawing Figures

SKIN MASSAGING DEVICE WITH SIMULTANEOUS APPLICATION OF A COSMETIC PRODUCT

BACKGROUND OF THE INVENTION

The present invention relates to a skin massaging device with simultaneous application of a cosmetic product, such as a liquid soap. This device comprises a reservoir for the cosmetic product, a massaging surface integral with the reservoir and having a series of protuberances adapted to exert a massaging action when the device is moved while the massaging surface is held against the skin, and at least one device which is integral with the massaging surface applying the cosmetic product.

Massaging apparatus which permit application of pharmaceutical or cosmetic products to the skin in liquid form are already known. One such apparatus, described in French Pat. No. 1,184,024, comprises an assembly of massage rollers and a reservoir for active products, and includes capillary orifices which permit the discharge of these products during the massage.

Another skin massage device, described in French Patent Publication No. 2,440,735, comprises balls housed in cells which communicate with a reservoir for a cosmetic product and the product discharges when the balls turn on themselves in their cells.

One drawback of all these devices is that their lack of seal and tightness permits oozing out, if not a definite discharge, of cosmetic product when the apparatus is at rest.

SUMMARY OF THE INVENTION

The present invention is directed at overcoming the above stated drawback by providing a massaging device which is sealed while it is at rest, which is of simple design and which is economical to produce. Furthermore, the simple massaging device seeks to provide a dosaging means within which the cosmetic product, which is automatically placed under pressure, is expelled in controlled manner and at a preset dose at the time of use.

For this purpose, in the massaging device of the invention, the device for applying the cosmetic product comprises a first protuberance on the massaging surface whose shape and dimensions are substantially identical to those of the other protuberances of the massaging surface and that first protuberance is retractable so as to open an orifice which permits the discharge of the product contained within the reservoir. The retractable protuberance includes a hollow housing in the massaging surface and communicating into the cosmetic product reservoir, a piston retractable into the housing and having the orifice therein and a rod in the housing for cooperating with the piston around the orifice to seat the orifice when the piston is in its extended, non-retracted position. The housing communicates with the reservoir through an opening that is closed by the piston retracting into the housing, whereby the cosmetic product in the housing is urged out of the piston orifice as the piston retracts.

Other objects and features of the present invention will be better understood by reference to the following description of an embodiment of the invention and the accompanying drawings.

DESCRIPTION OF A PREFERRED EMBODIMENT

Figure 1:
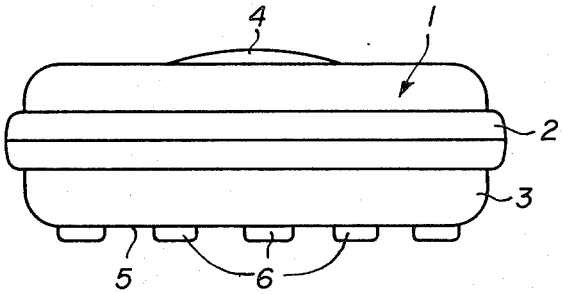
FIG. 1 is a side view in elevation of the massage device of the invention.
Figure 2:
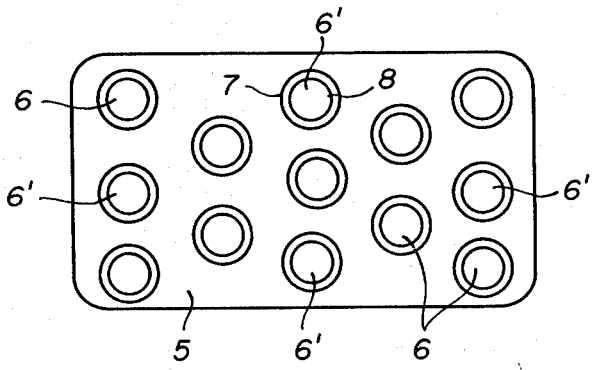
FIG. 2 is a bottom view of the device of FIG. 1.

Referring to the Figures, and particularly to FIGS. 1 and 2, the massage device of the invention comprises a reservoir 1 formed of two shells 2 and 3 assembled by known means, for instance detent means. The upper surface of the shell 2 has a filling orifice which is closed by a filling plug 4, described in further detail with reference to FIG. 5. The lower surface 5 of the lower shell 3, called the massaging surface, has a series of protuberances 6, which are described below.

The massaging surface 5, shown in FIG. 2, comprises four retractable protuberances 6' centered along the four sides of the surface 5 and nine fixed protuberances 6 dispersed across the surface 5. All of the protuberances 6, 6' include an annular peripheral bead 7 and a central circular flat surface 8 that is depressed into the massaging surface with respect to the bead.

Figure 3:
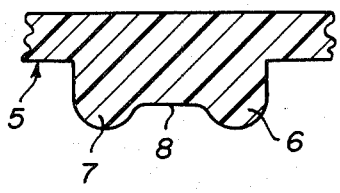
FIG. 3 is a partial view in cross-section of a stationary protuberance which is integral with the massaging surface of the device of FIGS. 1 and 2.

As shown in FIG. 3, the fixed protuberances 6 are firmly connected to the massage surface 5. They can either be attached to it or, preferably, they are made of one piece with the massage surface of the lower shell 3. The central circular surface 8 and the annular peripheral bead 7 are made in one piece and constitute a fixed protuberance 6.

Figure 4:
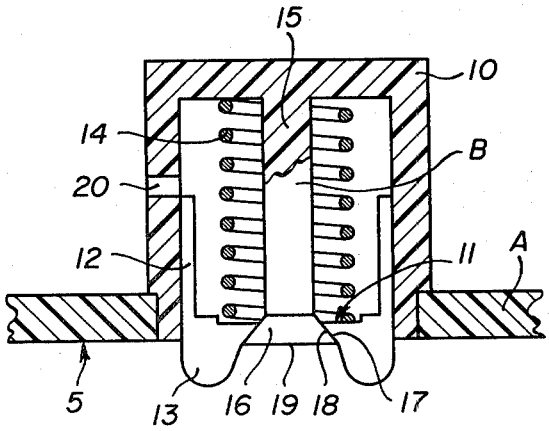
FIG. 4 is a sectional view through a device for the application of the cosmetic product.

FIG. 4 shows a sectional view through a device or protuberance 6' for the application of the cosmetic product. This device includes a housing 10 mounted within the lower shell 3 and extending into an opening provided in the massaging surface 5 of the shell. The opening in the massaging surface is perferably of circular shape, and the housing 10 is hollow and preferably of corresponding cylindrical shape. Within the housing 10 is mounted a hollow piston 11 of cylindrical shape having a peripheral, upstanding side wall 12 that is adapted to slide axially within and in contact with the interior side wall of the housing 10. At the top of the side wall 12 at the side facing out of the housing 10, there is an annular bead 13 that surrounds and defines a protuberance which is retractable with respect to the massaging surface 5. The bead 13 has a substantially semicircular cross-section, although its precise cross-section is not critical. The piston has a central opening through it, defined and surrounded by the bead 13. A coil spring 14 urges the piston 11 and its bead 13 into their extended position shown in FIG. 4.

A central rod 15 is rigidly connected with the housing 10. The rod 15 projects through the opening in the piston, making that opening annular around the rod, and particularly around the flat upper surface 19 of the rod. The rod 15 terminates at its upper or outward end in a conical outward flare 16. The conical surface 17 of the flare 16 on the rod serves as a support and as a stop for a complementary conical surface 18 arranged on the radially inward part of the opening in the piston at the base of the annular bead 13. In the position shown in FIG. 4, the piston 11 is pushed out by the coil spring 14 in such a manner that the conical surfaces 18 and 17 rest against each other for sealing the annular central opening in the piston that surrounds the flat, circular upper surface 19 at the top of the rod 15 and that is surrounded by the bead 13.

One or more openings 20 are provided in the side wall of the housing to permit the inside of the housing 10 to communicate with the reservoir in the shells 2, 3 which contains the cosmetic product.

When the user of the massaging device exerts a push on the annular bead 13 sufficient to cause the piston 11 to retract slightly into the housing 10, the openings 20 are closed off by the side wall 12 of the hollow piston 11. This prevents the return flow of the cosmetic product toward the inside of the reservoir and places the volume of product contained in the housing 10 under slight pressure. At the same time, the conical surface 18 moves away from the conical surface 17 and opens the annular orifice in the piston around the surface 19 through which the cosmetic product contained within the housing 10, and which product is slightly under pressure, discharges in the form of a pulsating jet. As soon as the pressure on the bead 13 is relaxed, the action of the coil spring 14 causes the piston 11 to return and close off the annular orifice defined between the conical surfaces 17 and 18.

Figure 5:
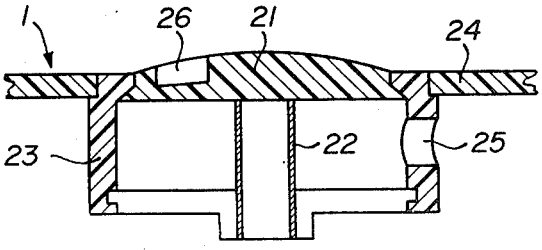
FIG. 5 is a sectional view through the filling plug of the reservoir of the device of the invention.

The reservoir filling plug 4 shown in FIG. 5 preferably has a slightly arched cap 21 mounted on a threaded cylindrical rod 22. This assembly is arranged within a housing 23 contained within an opening provided in the upper wall 24 of the shell 2 of the reservoir 1. The housing 23 has a cylindrical side wall provided with at least one opening 25 and a flat bottom having a threaded opening into which the cylindrical rod 22 is threaded. The cap 21 has a conical annular rim. In the closed position, the cap rim rests against the upper, similarly complementary conical rim of the housing 23. This assures the tight closing of the housing, which is in communication with the inside of the reservoir via the opening 25. The cap 21 preferably has three peripheral recesses 26 arranged at the apices of an equilateral triangle traced symmetrically on the upper surface of the cap 21. The recesses 26 are intended to cooperate with complementary protuberances provided on the surface of the cap of a supply bottle of cosmetic product intended to be introduced into the reservoir.

In the retracted position, the rod 22 is screwed into the threaded opening of the bottom of the housing 23 and the cap 21 is applied against the upper surface of the bottom, completely freeing access to the opening 25, which permits easy flow of the cosmetic product from a supply bottle toward the inside of the reservoir.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. Skin massage device with simultaneous application of a cosmetic product, the device comprising:

a reservoir for containing cosmetic product;

a massaging surface integral with and facing out from the reservoir, the massaging surface carrying a plurality of outwardly facing protuberances thereon which are adapted to exert massaging action while the massaging surface is moved over the skin;

a first plurality of first protuberances being for application of the cosmetic product; an orifice through the massaging surface at each first protuberance for escape therethrough of cosmetic product in the reservoir; the each first protuberance having an extended position at which the first protuberance blocks the orifice and also having a retracted position for opening the orifice, and the each first protuberance being movable to the retracted position upon application of pressure to the first protuberance through massaging the skin with the massaging surface;

each first protuberance of the first plurality comprising:

a hollow housing communicating into the reservoir, the hollow housing being defined by a peripheral wall; a hollow piston partially projecting into and contained within the housing and being shaped to be slidably movable along the housing wall; the hollow piston having a side facing outwardly of the massaging surface and that side of the piston having an opening therein communicating into the hollow piston, which opening serves as the orifice; the piston opening being defined and surrounded by a peripheral surface in the outwardly facing piston side; a spring for normally urging the piston out of the housing and out of the massaging surface;

a housing rod fixed on the housing and projecting through the piston opening; the housing rod having a cooperating surface placed and shaped for being engaged by the piston peripheral surface, when the piston is urged out of the housing, and when the piston is urged out of the housing, this is the extended position of the protuberance; the peripheral surface of the piston and the cooperating surface of the housing rod being engageable for sealing both the piston opening and the protuberance orifice against passage of the cosmetic product; the cooperating surface being placed so that with the piston pushed into the housing in the retracted position of the protuberance, the peripheral surface is separated from the cooperating surface for opening the piston opening and the protuberance orifice for passage of cosmetic product then in the housing;

a second plurality of second protuberances which are fixed to the massaging surface and are not retractable and do not include an orifice for escape of cosmetic product.

2. The skin massage device of claim 1, further comprising means for blocking return of cosmetic product from the housing to the reservoir when the piston opening is open and the piston is moving into the retracted position of the protuberance, whereby cosmetic product in the housing is caused to exit through the piston opening.

3. The skin massage device of claim 1, wherein the housing communicates with the reservoir through an opening in the housing; the piston includes a wall portion shaped and positioned to block that housing opening when the piston is retracted, for blocking exit of cosmetic product from the housing to the reservoir, whereby cosmetic product in the housing is caused to exit through the piston opening.

4. The skin massage device of claim 3, wherein the housing rod cooperating surface flares conically wider outwardly of the housing and the peripheral surface around the piston opening is conically flared complementary to the cooperating surface for sealing the piston opening when the peripheral surface and the cooperating surface are in engagement.

5. The skin massage device of claim 4, wherein each of said first and second protuberances having a shape comprising an annular bead projecting out of the massaging surface and a flat circular surface surrounded by the annular bead and the housing rod includes an outer surface facing outwardly of the massaging surface and this outer surface comprises the normally recessed flat circular surface surrounded by the bead.

6. The skin massage device of claim 1, wherein the housing rod cooperating surface flares conically wider outwardly of the housing and the peripheral surface around the piston opening is conically flared complementary to the cooperating surface for sealing the piston opening when the peripheral surface and the cooperating surface are in engagement.

7. The skin massage device of claim 1, wherein each of said first and second protuberances having a shape comprising an annular bead projecting out of the massaging surface and a flat circular surface surrounded by the annular bead and the bead has a substantially semicircular cross-section.

8. The skin massage device of claim 7, wherein the bead is defined on the piston.

9. The skin massage device of claim 1, wherein the housing is cylindrical.

10. The skin massage device of claim 9, wherein each of said first and second protuberances having a shape comprising an annular bead projecting out of the massaging surface and a flat circular surface surrounded by the annular bead and the piston opening is located centrally of the protuberance, the housing rod is located centrally of the housing, the protuberance is circular and the bead is annular.

11. The skin massage device of claim 1, wherein each of said first and second protuberances having a shape comprising an annular bead projecting out of the massaging surface and a flat circular surface surrounded by the annular bead and the piston opening is located centrally of the protuberance, the housing rod is located centrally of the housing, the protuberance is circular and the bead is annular.

* * * * *